US007770563B2

(12) United States Patent
Hamadani et al.

(10) Patent No.: US 7,770,563 B2
(45) Date of Patent: Aug. 10, 2010

(54) DEVICE FOR DISTRIBUTING RECIRCULATED GASES AND RECIRCULATED GAS-COOLING DEVICE COMPRISING ONE SUCH DEVICE

(75) Inventors: Gilles Hamadani, Bouray sur Juine (FR); Franck Levy, Guigneville (FR)

(73) Assignee: Renault s.a.s., Boulogne Billancourt (FR)

( * ) Notice: Subject to any disclaimer, the term of this patent is extended or adjusted under 35 U.S.C. 154(b) by 282 days.

(21) Appl. No.: 12/088,442

(22) PCT Filed: Oct. 2, 2006

(86) PCT No.: PCT/FR2006/050974

§ 371 (c)(1),
(2), (4) Date: Apr. 28, 2008

(87) PCT Pub. No.: WO2007/039701

PCT Pub. Date: Apr. 12, 2007

(65) Prior Publication Data

US 2008/0216802 A1 Sep. 11, 2008

(30) Foreign Application Priority Data

Sep. 30, 2005 (FR) ..... 05 52971

(51) Int. Cl.
*F02M 25/07* (2006.01)
*F02B 47/08* (2006.01)

(52) U.S. Cl. ..... 123/568.12; 123/568.24

(58) Field of Classification Search ..... 123/568.11, 123/568.12, 568.2, 568.21, 568.23, 568.24, 123/563; 60/599, 605.2
See application file for complete search history.

(56) References Cited

U.S. PATENT DOCUMENTS

| | | | | |
|---|---|---|---|---|
| 3,211,217 | A | 10/1965 | McKee et al. | |
| 4,323,116 | A | 4/1982 | Zimmerman | |
| 5,669,365 | A * | 9/1997 | Gartner et al. | 123/568.12 |
| 6,904,898 | B1 * | 6/2005 | Sahlen | 123/568.12 |

FOREIGN PATENT DOCUMENTS

| | | |
|---|---|---|
| DE | 3727467 | 3/1989 |
| EP | 0987427 | 3/2000 |
| EP | 1555421 | 7/2005 |
| FR | 2833653 | 6/2003 |
| JP | 11093781 A * | 4/1999 |
| WO | 2004011834 | 2/2004 |

OTHER PUBLICATIONS

U.S. Appl. No. 12/088,169, filed Mar. 26, 2008, Rollet.

* cited by examiner

*Primary Examiner*—Willis R Wolfe, Jr.
(74) *Attorney, Agent, or Firm*—Oblon, Spivak, McClelland, Maier & Neustadt, L.L.P.

(57) ABSTRACT

A device for distributing the exhaust gas from a motor vehicle engine in the direction of a component. The device includes: a gas inlet port and a gas outlet port that open onto a same first plane; an inlet port and an outlet port to the component, which open onto the same second plane that is parallel to the first plane; and a rotary mechanism disposed between the first and second planes, to enable the gas to flow in a first direction and in an opposite second direction. A cooling device can include such a device.

10 Claims, 2 Drawing Sheets

AA

DD

BB

CC

Figure 1A:
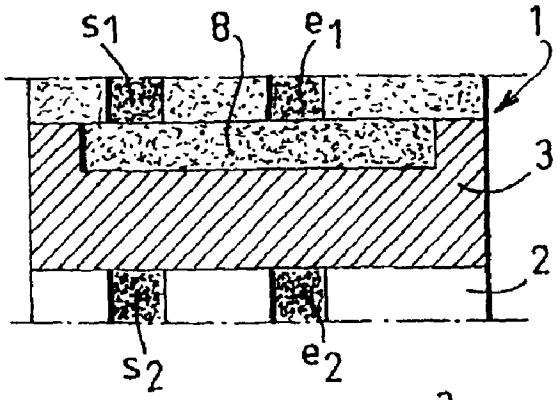

DEVICE FOR DISTRIBUTING RECIRCULATED GASES AND RECIRCULATED GAS-COOLING DEVICE COMPRISING ONE SUCH DEVICE

The invention relates to devices for recirculating exhaust gases, known as recirculated gases or EGR (exhaust gas recirculation) gases, and to EGR gas coolers comprising such devices.

To improve the removal of pollution from the exhaust gases of an internal combustion engine, recourse is had to the recirculation of exhaust gases to the inlet side, it being generally known as the use of an EGR circuit. In addition, the use of dedicated coolers for these gases allows this removal of pollution to be further enhanced.

However, one major problem is that recirculating the exhaust gases leads to substantial soiling of the components situated in this EGR circuit. This is why cleaning/clean-out sessions may be performed by opening the EGR valve (the EGR valve regulates the flow rate of EGR gases sent back to the inlet side) wide open when the engine is in a determined operating zone. This method, described in application FR2833653 allows the deposits that accumulate in the EGR circuit to be removed thermally.

This problem of soiling is not, however, completely resolved as far as the EGR cooler is concerned. The cooler is constantly operating, that is to say that there is always a flow of water passing through the exchanger. What then happens is that the cooler is perfectly cleaned on the inlet side when a clean-out phase is performed but the EGR gases which are constantly cooled are not hot enough to completely clean out the EGR cooler, especially in the second half of the water/EGR gas exchanger.

The invention is aimed at solving the problem of soiling of EGR coolers.

To this end, the invention proposes a device for distributing EGR gases in a motor vehicle engine to a component, which defines an inlet port and an outlet port for gas opening onto one and the same first plane, an inlet port and an outlet port towards the component opening onto one and the same second plane parallel to the first plane, and rotary means, positioned between the first and second planes, to allow gas to circulate in one direction and in the opposite direction.

According to other features of the invention:

- the rotary means may also be designed to allow metering of the EGR gas flow rate intended to be recirculated to the inlet side,
- the rotary means may comprise a cylindrical piece rotating about its axis of revolution, the two end faces of which lie facing the first and second planes, the cylindrical piece defining on its two faces slots for allowing the ports to communicate, these slots being designed so that depending on the angle through which the cylindrical piece is rotated, they allow the gas to flow in one direction or to flow in the opposite direction,
- the cylindrical piece may define two pairs of slots, the slots of the first pair being straight and the slots of the second pair being crossed,
- the rotary means may also be designed to bypass the component, for example the cylindrical piece may define a cavity on the face facing the first plane so as to allow the gas to flow directly from the inlet to the outlet,
- the cylindrical piece may comprise two slots, and in that the two slots, the gas inlet and the gas outlet, the inlet port and the outlet port may be of elongate shape and may be positioned in such a way as to allow, depending on the angle through which the cylindrical piece is rotated, the gas to flow in one direction, the gas to flow in the opposite direction, or the component to be bypassed, the component may be a heat exchanger.

The invention also relates to an EGR gas cooler, which comprises such a device. The cooler may be of the type comprising a heat exchanger arranged in the shape of a U.

Figure 1B:
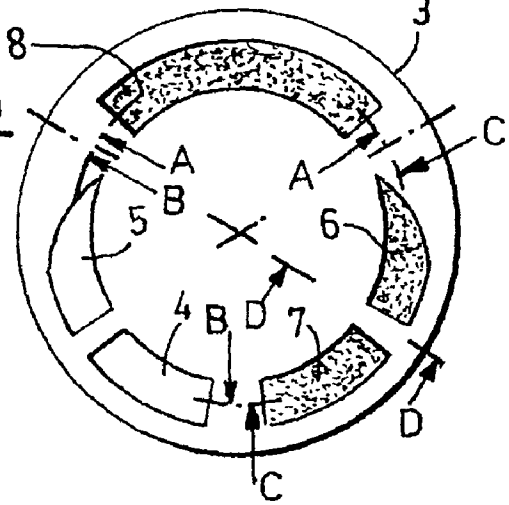
Figure 1C:
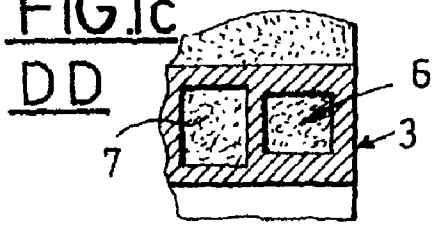
Figure 1D:
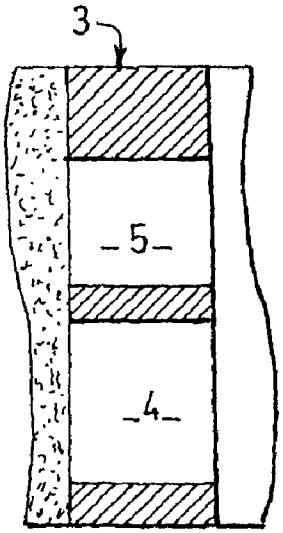
Figure 1E:
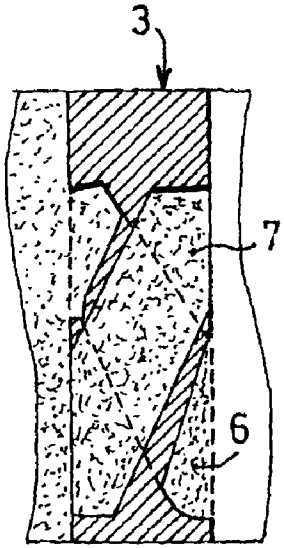
Figure 2:
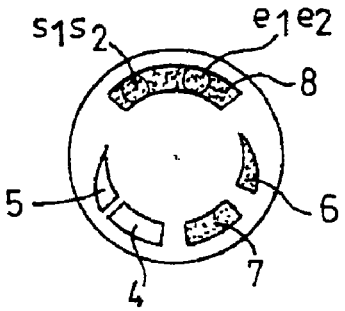
Figure 3:
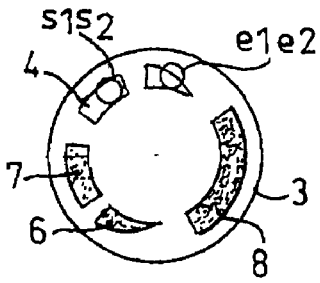
Figure 4:
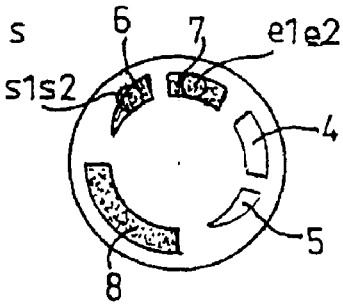
Figure 5:
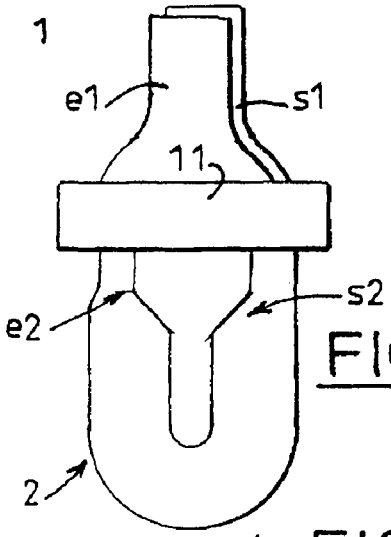
Figure 6:
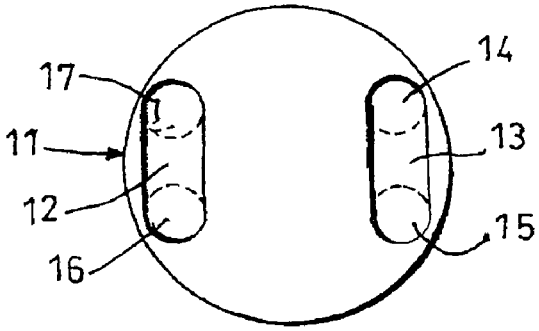
Figure 7:
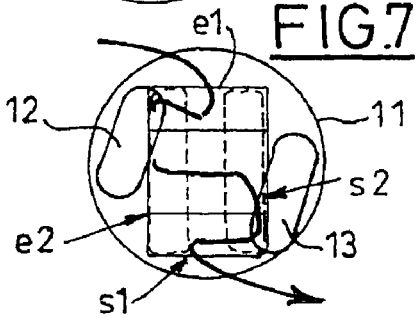
Figure 8:
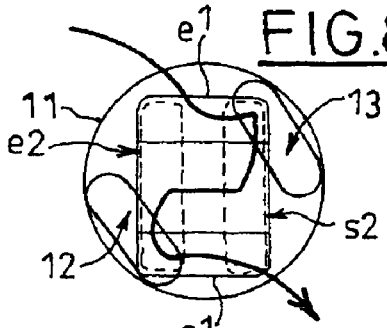
Figure 9:
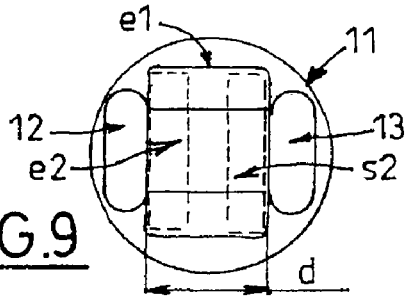
Figure 10:
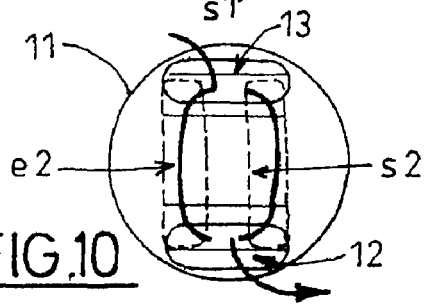

The present invention and its advantages will be better understood for reading the detailed description of one embodiment taken by way of entirely nonlimiting example and illustrated by the attached drawings in which:

FIGS. 1*a*, 1*b*, 1*c*, 1*d* and 1*e* are diagrams of a distribution device according to a first embodiment, FIG. 2 depicts the position of the cylindrical piece in bypass mode, FIG. 3 depicts the position of the cylindrical piece in normal flow mode, FIG. 4 depicts the position of the cylindrical piece in reverse flow mode, FIG. 5 depicts an EGR cooler equipped with a device according to a second embodiment, FIG. 6 depicts the cylindrical piece according to the second embodiment, FIG. 7 depicts the position of the cylindrical piece in normal flow mode, FIG. 8 depicts the position of the cylindrical piece in reverse flow mode, FIG. 9 depicts the position of the cylindrical piece in closed mode, FIG. 10 depicts the position of the cylindrical piece in bypass mode.

The distribution device is designed to direct the flow of recirculated gases from a motor vehicle engine to a component, for example towards a heat exchanger. This distribution device may form part of a recirculated gas cooler, for example an EGR gas cooler which comprises a U-shaped heat exchanger.

In general, the device defines an inlet port e1 and an outlet port s1 for gas opening onto one and the same first plane, an inlet port e2 and an outlet port s2 to the component 2 opening onto one and the same second plane parallel to the first plane, and rotary means positioned between the first and second planes to allow gas to flow in one direction and in the opposite direction.

The rotary means for reversing the flow comprises a cylindrical piece 3 rotating about its axis of revolution, the two end faces of which lie facing the first and second planes. The cylindrical piece 3 defines slots for allowing the ports (e1, s1, e2, s2) to communicate, these slots being designed so that, depending on the angle through which the cylindrical piece 3 is rotated, they allow the gas to flow in one direction or to flow in the opposite direction. The cylindrical piece 3 may be actuated by any means known to those skilled in the art. An electronic control unit will control this actuator.

According to a first embodiment illustrated in FIGS. 1 to 4, the cylindrical piece 3 defines two pairs of slots; the slots (4, 5) of the first pair are said to be "straight" (FIG. 1*a*), and the slots (6, 7) of the second pair are said to be "crossed" (FIG. 1*e*). In this embodiment, with reference to FIG. 1*a*, the gas inlet port e1 and the exchanger inlet port e2 face one another. The same is true of the outlet ports s1 and s2.

The slots (4, 5) of the first pair are said to be straight because they place ports which face one another in communication with one another. Thus, the slot 4 places the inlet ports e1 and e2 in communication with one another and the slot 5 places the outlet ports s1 and s2 in communication with one another (see FIGS. 1*a*, 1*d* and 3).

The slots (6, 7) of the second pair are said to be crossed (see FIG. 1*e*) because they place the inlet ports in communication with the outlet ports in such a way as to reverse the direction in which the EGR gases flow through the exchanger. Thus, the slot 6 places the inlet port e1 in communication with the outlet port s2, and the slot 7 places the outlet port s1 in communication with the inlet port e2 (see FIGS. 1*a*, 1*e* and 4).

FIG. 1*b* shows a nonlimiting exemplary embodiment in which the slots (4 to 7) have a radius of curvature such that they follow a circle 9 of a diameter smaller than the diameter of the cylindrical piece 3.

This arrangement therefore allows the direction in which the EGR gases flow to be reversed.

The rotary means may equally well be designed to allow metering of the EGR gas flow rate intended to be recirculated to the inlet side. The advantage of this is that the EGR gas flow rate can be controlled just as a conventional EGR valve would do.

To achieve this, the means that actuate the cylindrical piece 3 may be of the proportional type, that is to say may cause the cylindrical piece 3 to rotate to intermediate angles of rotation between the main positions (the normal flow position, the reverse flow position). These actuating means thus allow the area of overlap between the slots and the ports (e1, e2, s1, s2) to vary.

In a nonlimiting alternative form of embodiment depicted in FIGS. 1*b* and 2 to 4, one slot of each pair may define a section of decreasing profile. In FIG. 1*b* it can be seen that the slots 6 and 5 have this cross section of decreasing profile, that is to say that the upper arc of the profile comes to meet the lower arc at an end of section of the slot. It is this decreasing profile which, according to the angle through which the cylindrical piece is rotated, causes the area of overlap with the ports (e1, e2, s1, s2) to vary. By controlling the angle through which the cylindrical piece 3 is rotated, it is possible to vary the flow rate of the EGR gas intended to be recirculated to the inlet side both in the "normal" direction and when the flow passing through the heat exchanger 2 is flowing in the "reverse" direction.

According to an additional feature of the invention, the rotary means may also be designed to bypass the exchanger 2; nonlimitingly, a cavity 8 may be defined on the face facing the first plane so as to allow the gas to flow directly from the inlet e1 to the outlet s1 (see FIG. 2). This cavity 8 may for example be a circular longitudinal channel which follows the curve of the circle 9 and which is of a length that allows the inlet port e1 to communicate with the outlet port s1.

The channel and the two pairs of slots are positioned on the same circle 9.

A second embodiment is illustrated in FIGS. 5 to 10. As can be seen from FIG. 6, the cylindrical piece 11 defines two slots 12 and 13. This cylindrical piece 11 is located inside an EGR cooler (1) which comprises a heat exchanger 2 configured as a U (FIG. 5).

In FIG. 9, which depicts a geometric view of all the ports (e1, s1, e2, s2) and slots (12, 13) when the cylindrical piece 11 is in the closed position (that is to say when no gas flows to the exchanger 2), it can be seen that the two slots 12 and 13, the gas inlet e1 and the gas outlet s1, the inlet port e2 and the outlet port s2 are of straight elongate shape and positioned so that, depending on the angle through which the cylindrical piece 11 is rotated, they allow the gas to flow in one direction (FIG. 7) or to flow in the opposite direction (FIG. 8), or the exchanger 2 to be bypassed (FIG. 10).

By also controlling the angle through which the cylindrical piece 11 is rotated, it is possible to vary the area of overlap between the two slots (12, 13) and the inlet and outlet ports (e1, e2, s1 and s2) thus making it possible to meter the EGR gas flow passing through the exchanger and which is intended to be recirculated to the inlet side.

To achieve this, the inlet e1 and outlet s1 ports of the cooler 1 are mutually parallel. Likewise, the inlet e2 and outlet s2 ports of the exchanger 2 are mutually parallel. In addition, the inlet e1 and outlet s1 ports of the cooler 1 are inclined by 90° with respect to the inlet e2 and outlet s2 ports of the exchanger 2. The slots 12 and 13 are mutually parallel and offset by a distance at least equal to the width occupied by the inlet and outlet ports (e1, e2, s1 and s2) of the cooler 1 or of the exchanger 2. With reference to FIG. 9, it can be seen in this example that the slots 12 and 13 are offset by a distance d corresponding to the width of the two inlet e2 and outlet s2 ports of the exchanger 2.

The slots 12 and 13 made on the cylindrical piece 11 are nonlimiting. One might very well anticipate producing a drilling positioned at each end of each slot (12, 13). It would then be possible to end up with one slot and two drillings, or alternatively with four drillings only (see references 14, 15, 16, 17 in FIG. 6).

The geometric drawings of FIGS. 7 to 10 depict the various modes of the exchanger distribution device. The flow can flow only through those common regions that are shared by the slots and the ports. These regions represent the areas of overlap.

As illustrated in FIG. 7, the slot 12 of the cylindrical piece 11 places the inlet port e1 of the cooler in communication with the inlet port e2 of the heat exchanger 2. The slot 13 for its part places the outlet port s2 of the heat exchanger 2 in communication with the outlet port s1 of the cooler 1. The flow is then said to be in the normal direction, and small rotations of the cylindrical piece 11 can be used to vary the gas flow rate.

In FIG. 7, the direction in which the EGR gases flow is the reverse of that shown in FIG. 7. The slot 12 of the cylindrical piece 11 places the inlet port e1 of the cooler in communication with the outlet port e2 of the heat exchanger 2. The slot 13 for its part places the inlet port e2 of the heat exchanger 2 in communication with the outlet port s1 of the cooler 1. The flow is then said to be in the reverse direction, and small rotations of the cylindrical piece 11 can be used to vary the gas flow rate.

With reference to FIG. 9, none of the slots 12 and 13 places ports (e1, e2, s1, s2) in communication with one another. The cylindrical piece 11 is in the position known as the closed position. There is no circulation of EGR gases.

FIG. 10 depicts the cylindrical piece 11 in the bypass position. The slots 12 and 13 place all the ports (e1, e2, s1, s2) in communication with one another. The flow of EGR gases therefore passes through the slots 12 and 13 but not through the heat exchanger 2 because the flow of gas is redirected actually within the inlet e2 and outlet s2 ports of the heat exchanger 2.

One of the advantages is that the distribution device according to the invention performs three functions. The first is to reverse the flow of EGR gases flowing through the exchanger to remedy the soiling problem. The second is to meter the flow of EGR gases. This function is normally performed by an EGR control valve. The third is that of being able to bypass the heat exchanger of the cooler. This function is normally performed by a parallel bypass circuit. The present invention therefore displays the advantage that some components in the EGR system can be omitted.

An additional advantage of the second embodiment is that it is possible to perform a controlled cooling of the flow of EGR gases when these are flowing at their maximum flow rate: between the bypass position and the normal direction position of the cylindrical piece 11 the EGR gas flow rate remains the same. The difference lies in the proportion of EGR gases that will be directed through the bypass by comparison with the proportion that will pass through the heat exchanger 2. Thus, by controlling the actuating means proportionately it is possible to influence the temperature of the EGR gases that will be recirculated to the inlet side. It is possible to achieve the same controlled cooling with the cylindrical piece 11 between its bypass position and its reverse flow position.

The invention claimed is:

1. A device for distributing exhaust gases in a motor vehicle engine to a component, comprising:

an inlet port and an outlet port for gas opening onto one and a same first plane;

an inlet port and an outlet port to the component opening onto a same second plane parallel to the first plane; and rotary means, positioned between the first and second planes, for allowing gas to circulate in a first direction and in a second direction opposite the first direction.

2. The device as claimed in claim 1, wherein the rotary means further allows metering of a flow rate of gas to be recirculated to an inlet side.

3. The device as claimed in claim 1, wherein the component includes a heat exchanger.

4. The device as claimed in claim 1, wherein the rotary means further bypasses the component.

5. The device as claimed in claim 4, wherein a cavity is defined on a face facing the first plane so as to allow the gas to flow directly from the inlet to the outlet without passing through the component.

6. A recirculated gas cooler, comprising a distribution device as claimed in claim 1.

7. The cooler as claimed in claim 6, further comprising a heat exchanger arranged in a shape of a U.

8. The device as claimed in claim 1, wherein the rotary means comprises a cylindrical piece rotating about its axis of revolution, two end faces of which lie facing the first and second planes, the cylindrical piece defining on its two faces slots for allowing the ports to communicate, the slots configured so that depending on an angle through which the cylindrical piece is rotated, the slots allow gas to flow in the first direction or to flow in the second opposite direction.

9. The device as claimed in claim 8, wherein the cylindrical piece defines two pairs of slots, the slots of the first pair being straight and the slots of the second pair being crossed.

10. The device as claimed in claim 8, wherein the cylindrical piece comprises two slots, and the two slots, the gas inlet and the gas outlet, and the inlet port and the outlet port leading to the component are of elongate shape and are positioned to allow, depending on the angle through which the cylindrical piece is rotated, the gas to flow in the first direction, the gas to flow in the second opposite direction, or the component to be bypassed.

* * * * *